US009809995B2

(12) United States Patent
Irwin et al.

(10) Patent No.: US 9,809,995 B2
(45) **Date of Patent: *Nov. 7, 2017**

(54) HIGH-STRENGTH LOCK

(71) Applicant: UNITED STATES POSTAL SERVICE, Washington, DC (US)

(72) Inventors: Donald E. Irwin, Fredricksburg, VA (US); Michael L. Spears, Chantilly, VA (US); Robert Dalton, Greenville, SC (US)

(73) Assignee: UNITED STATES POSTAL SERVICE, Washington, DC (US)

( * ) Notice: Subject to any disclaimer, the term of this patent is extended or adjusted under 35 U.S.C. 154(b) by 9 days.

This patent is subject to a terminal disclaimer.

(21) Appl. No.: 15/048,326

(22) Filed: Feb. 19, 2016

(65) Prior Publication Data

US 2016/0168876 A1 Jun. 16, 2016

Related U.S. Application Data

(63) Continuation of application No. 12/004,856, filed on Dec. 21, 2007, now Pat. No. 9,273,487.

(Continued)

(51) Int. Cl.

| | |
|---|---|
| ***E05B 9/04*** | (2006.01) |
| ***E05B 15/16*** | (2006.01) |
| ***E05B 17/04*** | (2006.01) |
| ***E05C 3/04*** | (2006.01) |
| ***B65D 55/14*** | (2006.01) |

(Continued)

(52) U.S. Cl.

CPC ..... *E05B 9/04* (2013.01); *B65D 55/14* (2013.01); *E05B 15/16* (2013.01); *E05B 17/04* (2013.01); *E05B 27/0003* (2013.01); *E05B 65/006* (2013.01); *E05B 65/52* (2013.01); *E05C 3/042* (2013.01); *Y10T 70/5093* (2015.04)

(58) Field of Classification Search

CPC ... E05B 9/00; E05B 9/04; E05B 9/048; E05B 2009/004; E05B 27/00; E05B 27/0003; E05B 27/001; E05B 27/0014; E05B 15/16; E05B 15/1614

See application file for complete search history.

(56) References Cited

U.S. PATENT DOCUMENTS 1,433,363 A * 10/1922 Freysinger ..... E05B 9/04 70/373
1,699,757 A * 1/1929 Segal ..... E05B 27/00 70/367

(Continued)

FOREIGN PATENT DOCUMENTS

WO WO 2008/080095 A2 7/2008

OTHER PUBLICATIONS

Ad: Introducing New Postal Locks CompX National (1 page ).

(Continued)

*Primary Examiner* — Christopher Boswell
(74) *Attorney, Agent, or Firm* — Finnegan, Henderson, Farabow, Garrett & Dunner, L.L.P

(57) ABSTRACT

Described herein is locking apparatus, method for making a locking apparatus, and method for mounting a locking apparatus to the door of a personal storage container. The locking apparatus may include a threaded portion having deformed threads and a lock body shape to fit a restrictive mounting hole.

16 Claims, 7 Drawing Sheets

Related U.S. Application Data

(60) Provisional application No. 60/876,167, filed on Dec. 21, 2006.

(51) Int. Cl.
*E05B 27/00* (2006.01)
*E05B 65/00* (2006.01)
*E05B 65/52* (2006.01)

(56) References Cited

U.S. PATENT DOCUMENTS 1,707,643 A * 4/1929 Segal ..... E05B 27/0014 70/367
1,888,954 A * 11/1932 Keil ..... E05B 27/00 29/510
2,014,233 A * 9/1935 Keil ..... E05B 27/00 70/367
2,022,070 A * 11/1935 Williams ..... E05B 27/00 70/359
2,255,402 A 9/1941 Vile
2,487,803 A 11/1949 Heimann
2,837,908 A * 6/1958 Segal ..... E05B 9/086 70/367
3,102,412 A 9/1963 Christopher
3,173,466 A 3/1965 Starriett et al.
3,190,092 A 6/1965 Patriquin
3,197,985 A * 8/1965 Orozco ..... E05B 27/00 70/367
3,408,840 A 11/1968 Hasenbein
3,600,912 A 8/1971 Foreman
3,702,553 A 11/1972 Nolin
3,789,638 A 2/1974 Roberts et al.
5,152,161 A 10/1992 Lee
5,279,138 A 1/1994 Gallagher
5,435,159 A 7/1995 Ramsauer
5,479,800 A 1/1996 Myers
5,491,993 A 2/1996 Anderson
5,685,184 A 11/1997 Gallagher
5,713,708 A 2/1998 Van derDrift et al.
6,012,311 A 1/2000 Duckwall
6,155,090 A 12/2000 Rubensson
6,508,092 B1 1/2003 Laabs et al.
6,514,025 B2 2/2003 Watanabe
7,003,994 B2 2/2006 Ruan
7,194,876 B1 3/2007 Pacheco et al.
7,251,970 B2 8/2007 Mielonen
7,574,882 B2 * 8/2009 Uliano ..... E05B 27/083 70/404
7,762,111 B2 * 7/2010 Damikolas ..... E05B 9/04 70/367
8,336,348 B2 * 12/2012 Dalton, Jr. ..... E05B 9/086 70/337
D692,744 S 11/2013 Dalton
9,273,487 B2 * 3/2016 Irwin ..... E05B 9/04
2002/0104344 A1 8/2002 Nieves
2004/0206142 A1 * 10/2004 Boesel ..... E05B 77/34 70/417
2006/0137416 A1 6/2006 Chang

OTHER PUBLICATIONS

Ad: New 2006/07, CompX National New Postal Locks (1 page).
PCT Search Report and Written Opinion for International Application. No. PCT/US2007/088641, dated Sep. 24 and Sep. 29, 2008 (7 pages).
United States Postal Service Specification Patron Lock, Centralized Delivery Equipment (CDE) (PSIN 0910A & B) (7 pages).
Federal Register: Sep. 3, 2004 (vol. 69, No. 171), Rules and Regulations, pp. 53808-53834 (28 pages).
International Preliminary Report on Patentability, dated Jul. 2, 2009, for PCT application No. PCT/US2007/088641, filed Dec. 21, 2007 (8 pages).

* cited by examiner

HIGH-STRENGTH LOCK

RELATED APPLICATIONS

This application is a continuation of U.S. patent application Ser. No. 12/004,856, filed Dec. 21, 2007, which claims benefit of priority to U.S. Provisional Patent Application No. 60/876,167, filed Dec. 21, 2006, all of which are incorporated herein by reference.

TECHNICAL FIELD

This invention relates generally to locking improvements for security of patron storage devices, and, more particularly to a locking apparatus and method that provide increased security of patron storage devices by withstanding high cantilevered load requirements while also meeting a high threshold corrosion resistance requirement using commonly available, cost-effective parts.

BACKGROUND

The incidence of theft from personal storage containers is on the rise. For example, the number of reported attacks on wall-mounted personal mail storage containers increased from 988 in 2000 to 2,819 in 2002.[1] This increase in the number of thefts from wall-mounted personal storage containers highlights the need for improvements in the securing of personal storage lockers and delivered-goods lockers. This need for improvement also exists due to the potential for identity theft and loss of personal privacy, which result from theft in general.

[1] Postal Service 39 CFR 111, Standards Governing the Design of Wall-Mounted Centralized Mail Receptacles, Final Rule.

Visual inspection, forensic analysis, and engineering testing measures of locks and storage containers have demonstrated that improvements in locks and storage containers could increase the security of items placed within the storage containers. With the rise in incidences of identity theft, improvements in security of personal information also becomes more important. As more and more goods are purchased through the Internet and shipped directly to a purchaser, securing of these delivered valuables becomes more important. Better equipment would improve the security of valuables and personal information within the storage container from theft.

Conventional methods of compromising and/or breaking into the storage containers are well documented. Methods include prying open the door of such containers with a flat head screw driver and gripping the cylinder collar of the locker lock with vise grips to remove the lock with torsion force.

A multitude of mechanical failures can occur upon application of a low cantilever load to the door of the storage container or upon the application of a low cantilever load to the lock itself. For example, fracture of the cam end of the lock plug may occur, causing the door to open. Other possible mechanical failures include fracture of the plug body and severing of the end of the cam from the plug. This latter mechanical failure also results in the door opening.

Similarly, compromising the security of the storage container via gripping the cylinder collar with vise grips and removing the lock with torsion force can lead to a multitude of mechanical failures. For example, under torsion, mechanical failures may include the loosening of the plug nut, which allows the cam to rotate more freely and the lock to open. The plug nut may also completely disengage from the bolt, resulting in the cam falling off the end of the plug. Because the cam engages the frame of the storage container or equivalent and prevents the door from opening, when the cam falls off the plug, the door readily opens.

Previous solutions to the problem of increasing the security of storage containers include the United States Postal Service ("USPS") USPS-L-1172C version lock and associated locker system. The USPS-L-1172C lock can withstand a previously unachievable 1000-pound cantilever load requirement, an increase of 800% over earlier personal storage container locks. The USPS-L-1172C's plug design and cylinder could withstand the resultant forces of a 1000-pound cantilever load on a lock installed in a personal storage locker.[2] This 1172C version lock also can withstand 1000-pound load applied to the cam, which is the part of the apparatus attached to the threaded end of the plug.

[2] The plug is the center rotating piece of a lock into which the key is inserted. The cylinder is the stationary piece of the lock that houses the plug and interfaces with the storage container door.

The 1172C meets the 1000-pound criteria with room to spare. Both the material and design contributed to the improved performance of the 1172C. The previous low-cost, but low-strength Zinc die-cast material for the plug was changed to a metal injection molded, precipitation hardened, stainless steel material. Manufacturing the plug in this way resulted in a 5/16s thread of extreme strength on the plug without requiring any secondary machining processes. Additionally, manufacturing the plug this way had the additional advantage of being reasonably economical.

Design changes to meet the 1000-pound load criteria in the 1172C over previous versions included a locking plug nut. Because of this nut, the USPS-L-1172C could withstand aggressive torque load to its face without becoming loose or disassociated from the personal storage device. The USPS-L-1172C locking apparatus comprised a locking plug nut, which did not back off of the end of the plug bolt with vibration, cantilever load on the door of the storage container, or tensile load to the face of the cylinder.

Despite the great strength of the 1172C, increased strength and increased life may be warranted in locations known to have a high incidence of theft. Further, some environmental conditions require an increased resistance to corrosion. Changes in the existing lock apparatus are therefore desirable to meet higher break-in load criteria and increased corrosion resistance criteria.

The 1172C version of the plug specified a standard thread form that required a thread-locking style plug nut to provide adequate "grip" of any installed cam and also required a specialized version of one specific self-locking style nut that had been the only successful version to test out at load values exceeding the 1000-pound requirement. This superior strength performance came at a price of unexpected installation issues, however. In particular, the torque required to completely seat this self-locking nut exceeded, for most installers, the amount of torque that could be generated by previous standard installation methods and tools, for example a nut driver. Accordingly, it was sometimes necessary for installers to use a ratchet nut driver to properly install the prior art lock system. Thus, it is desirable to use a widely available standard nut as a plug nut, as opposed to the self-locking version used on the plug of the 1172C lock, enabling maintenance personnel to install a new lock with only a nut driver. It is further desirable to use less expensive plug nuts available in great numbers for convenience and cost efficiency.

Accordingly, it is desirable to provide a lock, locking method, and locking system that meets high load and corrosion resistance criteria. Moreover, it is desirable to provide a lock, a locking method, and a locking system that allows for installation of a new lock with only a nut driver. Finally, it is desirable to provide a lock, locking method, and locking system using widely available and cost-effective nuts.

SUMMARY

A locking apparatus for locking a box using a cam comprises a cylinder, a rotatable plug positioned inside the cylinder, a pin assembly for receiving a key to selectably prevent and permit rotation of the plug, and a nut cooperating with the threaded portion of the plug to capture the cam. The plug comprises a threaded portion. The threaded portion comprises a deformed portion providing a retention force between the threaded portion of the plug and the nut to resist removal of the nut from the threaded portion.

It is to be understood that both the foregoing general description and the following detailed description are exemplary and explanatory only and are not restrictive of the invention, as claimed.

BRIEF DESCRIPTION OF THE DRAWINGS

The drawings, which are incorporated in and constitute a part of this specification, illustrate embodiments of the invention and together with the description, serve to explain the principles of the invention. Wherever possible, the same reference numbers will be used throughout the drawings to refer to the same or like parts.

DESCRIPTION OF THE EMBODIMENTS

Figure 1:
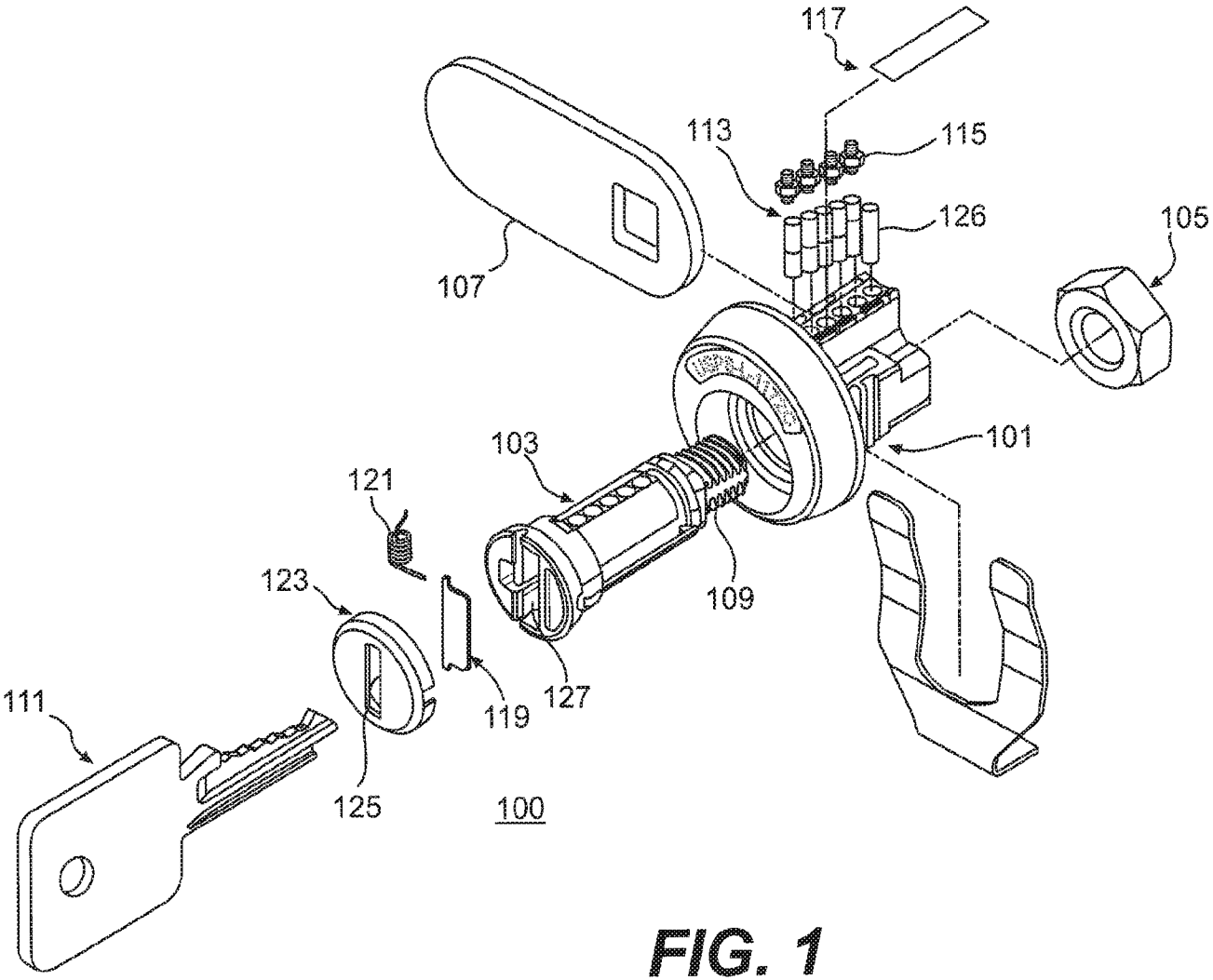
FIG. 1 is an exemplary lock with its constituent components consistent with the present invention.
Figure 2A:
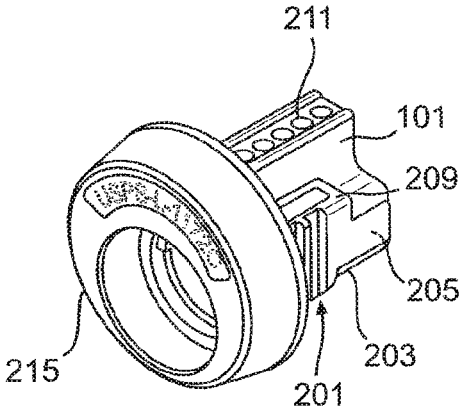
FIGS. 2(*a*)-(*d*) depict various views of a cylinder of the lock of FIG. 1.
Figure 2B:
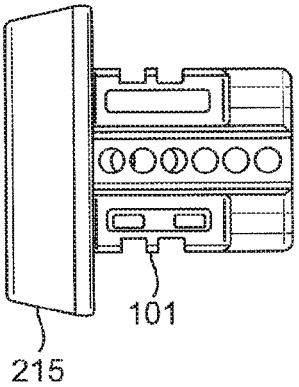
Figure 2C:
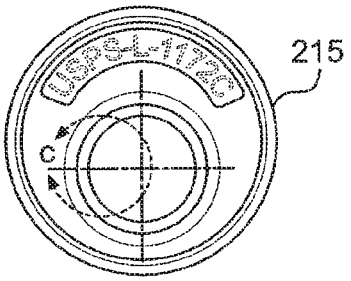
Figure 2D:
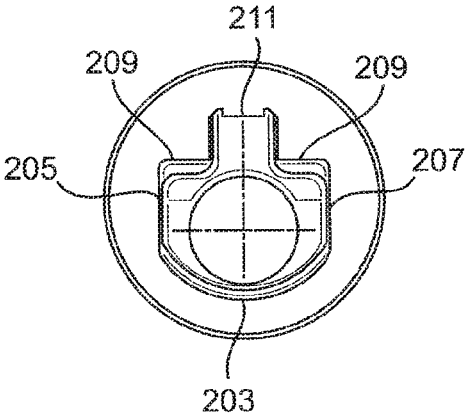

Operational Principles of Cylinder Locks with Pin-and-Tumbler Design

Cylinder locks with a pin-and-tumbler design are generally comprised of an outer casing, known as a cylinder, which houses a plug and a pin assembly. The plug further comprises a keyway, and is attached to a cam via a plug nut. In order for the lock to open, the plug must rotate. When the proper key is inserted into the keyway, the plug rotates in a certain direction along with the attached the cam, and the door, secured by the lock, opens. The rotation of the plug in the other direction rotates the cam back into the locked position and closes the door.

In order to permit rotation of the plug, the correct key must be inserted into the keyway of the plug. When the correct key is inserted into the keyway, the pin assembly of the lock moves to a predefined position allowing the plug to rotate. Specifically, the pin assembly in a pin-and-tumbler design cylinder lock consists of a plurality of pins and a plurality of springs, both of varying lengths. Each pin is comprised of a driver pin positioned on top of a tumbler pin. Each driver-tumbler pin pair resides in its own two-part shaft oriented vertically in the cylinder and the plug. In other words, a plurality of holes exist, one for each pin pair. Springs positioned at the top of each shaft directly above each driver pin keeps each pin pair in place.

Before a key is inserted into the keyway of the plug, the tumbler pin of each pin pair resides completely within the plug. The driver pins of each pin are positioned to be partially in the plug and partially in the cylinder. The position of the driver pins keeps the plug from turning, ensuring that the lock stays locked.

When the correct key is inserted into the keyway, the series of notches in the key push the pin pairs up to different levels. Only the correct key allows each pin pair to move such that the driver pins are positioned completely outside of the plug and are aligned with the shear line of the lock. The shear line of the lock is the point where the cylinder and plug of the lock meet. At the shear line, and with the driver pins positioned completely in the cylinder of the lock, the plug can now move freely, which in turn allows the cam to move freely. This free movement of the plug and cam results in the opening of the lock.

EMBODIMENTS

Reference will now be made in detail to exemplary embodiments consistent with the invention, examples of which are illustrated in the accompanying drawings. Wherever possible, the same reference numbers will be used throughout the drawings to refer to the same or like parts.

Examples of a novel locking apparatus and method are disclosed. Generally, the principles of such a locking apparatus and method are described with respect to wall-mounted lock boxes for mail. However, one skilled in the art will recognize that the principles described below apply to any storage container or box, including personal storage containers, in which a cylinder lock with pin-and-tumbler design may be deployed.

The disclosed lock and associated methods provide both an economical solution to and significant protection against attempts to break into storage containers and help to reduce the incidence of theft. The disclosed lock is improved, has several unique design features and has unique performance capabilities as compared to prior versions of the USPS-L-1172 lock and as compared to other conventional similar locks. The disclosed lock also provides ease of use to the patron of the storage container.

Referring now to FIG. 1, an exemplary lock system 100 consistent with the invention is illustrated. System 100 comprises a cylinder 101 in which a plug 103 resides. A nut 105 captures a cam 107 to the threaded portion 109 of plug 103. Cam 107 may have various shapes, including a hook shape or an oval shape.

In this embodiment, system 100 uses a five-pin tumbler-style lock, providing ample security in diversity of the key codes, while also readily enabling cutting of a key 111 from blanks using typical cutting tools. Accordingly, system 100 may comprise pin assembly comprising five pairs of pins 113 and five springs 115. A plug retainer 126 may also be used to affix the plug to the cylinder. A spring retainer 117 may be used to keep the pins 113 and plug retainer 126 in place.

In one embodiment, a spring-hinged stainless steel dust cover 119 may be braced by a spring 121 over the keyhole 125 of plug 103. A plug cap 123 with a keyhole 125 may be affixed over the dust cover 119 to such that keyhole 125 lines up with keyway 127 of plug 103. Dust cover 119 may resiliently move from a first position covering the keyhole to a second position uncovering the keyhole. This feature may reduce the opportunity for corrosion and the accumulation of particulates in the shaft of the plug. This design may additionally maintain the integrity of the locking mechanism over time, while permitting easy access and manipulation by the patron. Both clockwise and counter-clockwise models of system 100 may be provided.

Referring now to FIGS. 2(*a*)-(*d*), various views of an exemplary cylinder 101 are shown. Cylinder 101 may be attached to a collar 215, as shown in FIG. 2(*c*). Moreover, together with plug 103 (not shown in FIGS. 2(*a*)-(*d*)) and plug retainer 126, cylinder 101 forms a lock body 201.

In one embodiment, the shape of lock body 201 may deviate from the industry-standard lock body. Rather than being cylindrical in shape, the shape of lock body 201 may have an arced bottom edge 203, two substantially straight side edges 205, 207 and a straight top edge 211 with two notched portions 209 positioned on the sides of top edge 211 of the cylinder. Notched portions 209 on top edge 211 of cylinder 101 runs down the entire length of cylinder 101. The resulting shape provides the capacity for lock system 100 to accommodate a restrictive hole pattern in addition to the typical mounting hole pattern, a nominal 0.635"×0.750" double-D hole pattern, which has been in use for decades. The unique shape of the lock body 201 prevents older generation double D-shaped locks from being used in newer storage doors that have a mounting hole pattern cutout corresponding to the shape of lock body 201, while still enabling newer lock system 100 to be installed in older storage units.

Consistent with the invention, the profile of collar 215 on cylinder 101 may be beveled to retard gripping about the circumference of the cylinder exposed on the outside of the storage unit. This design may resist, for example, gripping of the cylinder collar with vise grips and removing the lock with torsion force.

Modifying cylinder 101 may be another way to achieve increased security. The following descriptions represent exemplary improvements in the lock design, consistent with the invention.

The cylinder in the prior art 1172C is made from nickel-plated zinc alloy die cast material. Replacing this material with stainless steel materials would allow either (a) the Metal Injection Molding (MIM) method, (b) die cast method with secondary machining, or (c) machining as the fabrication method for this part. This is the same material currently used with the mating plug part, which is manufactured by MIM. Alternate materials, not currently used in the 1172C may also be used in forming the plug and/or the cylinder. These materials include: precipitation-hardened stainless steel in accordance with MPIF standards 35, MIM-17-4 PH, condition H900; and age-hardened stainless steel casting, in accordance with ASTM A 747 grade CB7CU-1, type 17-4, condition H900; and precipitation hardened stainless steel in accordance with ASTM A 564, type 630, condition H900. These materials can provide even more structural integrity of the lock and security.

This material improvement to cylinder 101, coupled with the existing performance of plug 103, may provide for a lock system 100 that not only meets the existing set of strength and security type tests, but may be capable of withstanding additional security testing, such as hammer hits, drilling, etc., to a significantly higher degree. In addition, the use of any of these stainless steel materials may result in a lock system 100 with significant improvement in environmental corrosion resistance over the current nickel-plated, zinc alloy die cast cylinders and result in a longer service life.

Since a lock system consistent with the present invention is somewhat similar in appearance to prior art lock systems, a lock system consistent with the present invention may include a distinctive legend, such as a model number, inscribed or otherwise permanently displayed on the face of cylinder 101, for ease of recognition by delivery personnel and storage locker patrons.

Figure 3:
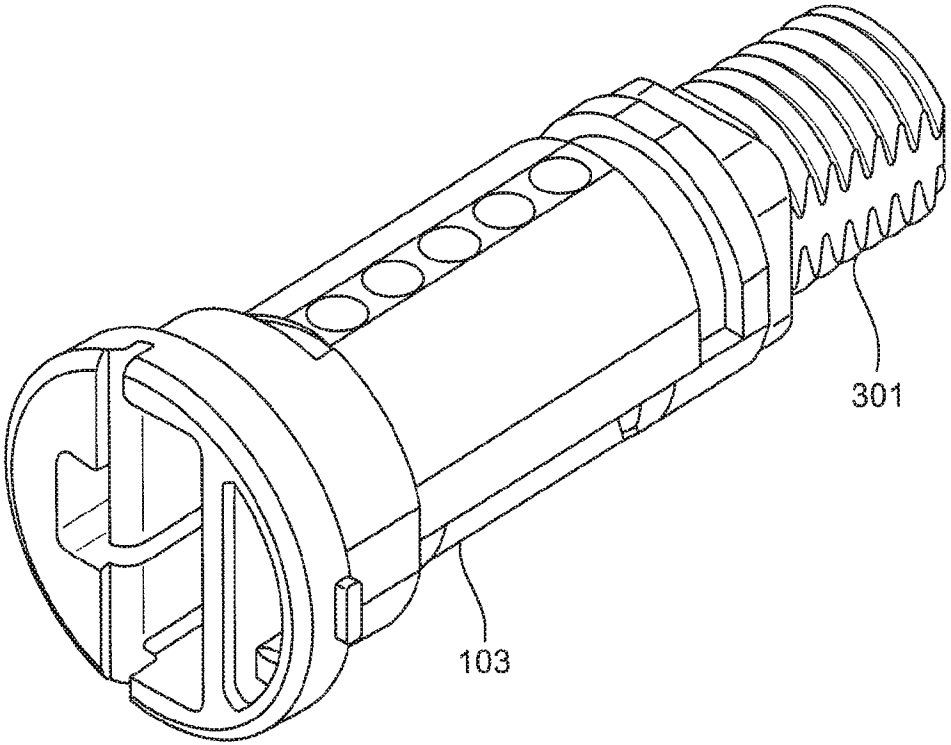
FIG. 3 depicts an exemplary plug for use in the lock of FIG. 1.

Referring now to FIG. 3, plug 103 consistent with the invention is shown. Several novel design features exist in plug 103, which may contribute to the increased security properties of system 100. The prior art USPS-L-1172C lock has a stainless steel plug, which was formed into its configuration through metal injection molding (MIM), providing greatly improved strength over previous versions while maintaining economical production. Accordingly, the prior art lock withstands aggressive torque load to its face without becoming loose or disassociated from the storage container. The prior art locking apparatus comprised a self-locking nut, which did not back off of the end of the plug bolt even when subjected to vibration, cantilever load on the door of the storage container, or tensile load to the face of the cylinder.

Consistent with the invention, a self-locking feature may be provided, using threads 301 of plug 103. In particular a self-locking feature may be incorporated into at least a portion of threads 301 of plug 103 by deforming plug threads 301, such as by notching, crimping, warping, flattening the threads, or by using asymmetrical thread spacing. Alternatively, deformation of plug threads 301 may occur during a metal injection molding process (MIM). Thus, the required strength of the thread-to-thread grip of the plug and nut may be such that any standard nut could be used on plug 103. Deforming plug threads 301 and threading nut 105 thereon causes a retention force to exist between plug threads 301 and nut 105, securing nut 105 to plug 103 such that nut 105 may resist removal from plug threads 301. Thus, nut 105 may not be unintentionally removed from the end of plug 103 due to vibration, cantilever load on the door of the storage container, or tensile load to the face of cylinder 101. This not only may provide easier installation in terms of complexity and effort, but also may provide cost reduction by elimination of the prior art specialized locking nut.

It is desirable for some applications to provide increased resistance to chemical corrosion of the plug. Such corrosion may result from either ambient conditions or deliberate attempts to compromise the lock.

The use of alternate stainless steel materials for plug 103 over prior art plug MIM material may provide diversity in materials, manufacturing, and performance. Selecting the MIM process requires a very large expected production volume to justify the tooling investment. Thus, two stainless steel materials described above as alternate cylinder materials may also be used for plug 103, consistent with the invention. These alternate materials may provide material options to future licensed suppliers that accommodate alternative manufacturing processes for the disclosed plug. Consistent with the invention, the same material from those listed above may be chosen for both plug 103 and cylinder 101.

Figure 4:
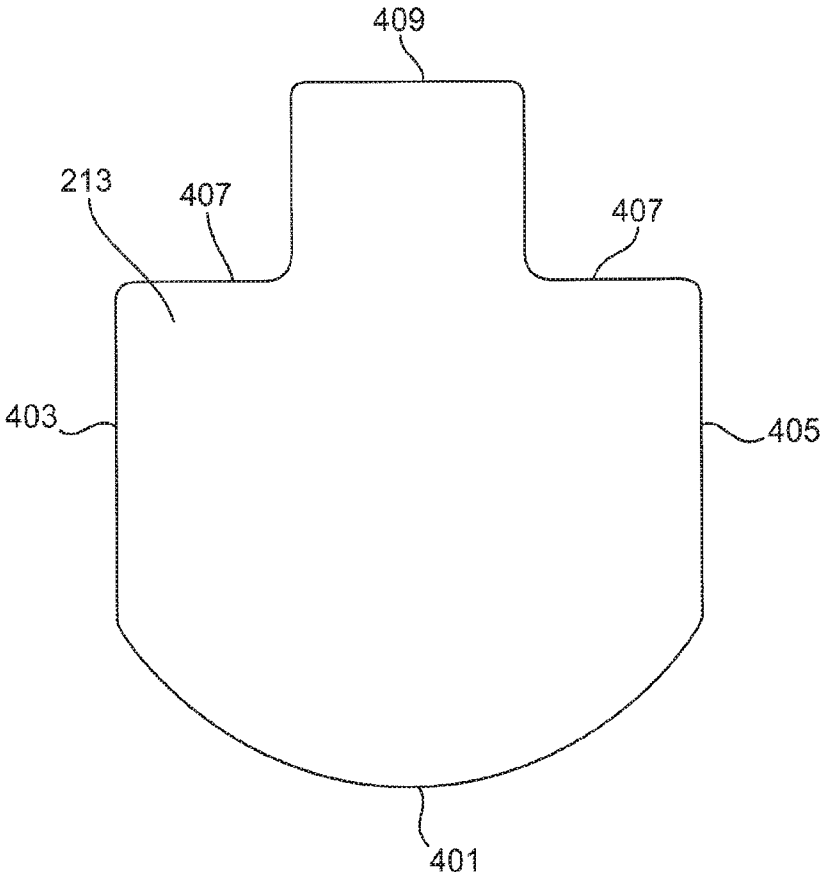
FIG. 4 depicts an exemplary restrictive mounting hole pattern for use in the lock of FIG. 1.

Referring now to FIG. 4, restrictive mounting hole 213 consistent with the invention is shown. Restrictive mounting hole 213 may be formed into the door of the storage container to be locked. For example, a wall-mounted lock box for mail (not shown) may have restrictive mounting hole 213 cut into its door. Consistent with the invention, lock system 100 may be configured to accommodate restrictive hole pattern 213 in addition to the typical mounting hole pattern, a nominal 0.635"×0.750" double-D hole pattern, which has been in use for decades, because of the unique shape of the lock body 201. Like the shape of the lock body 201, restrictive mounting hole 213 may be other than cylindrical in shape. Restrictive mounting hole 213 may have an arced bottom edge 401, two substantially straight side edges 403, 405, and a straight top edge 409 with two notched portions 407 on either side of straight top edge 409.

Figure 5A:
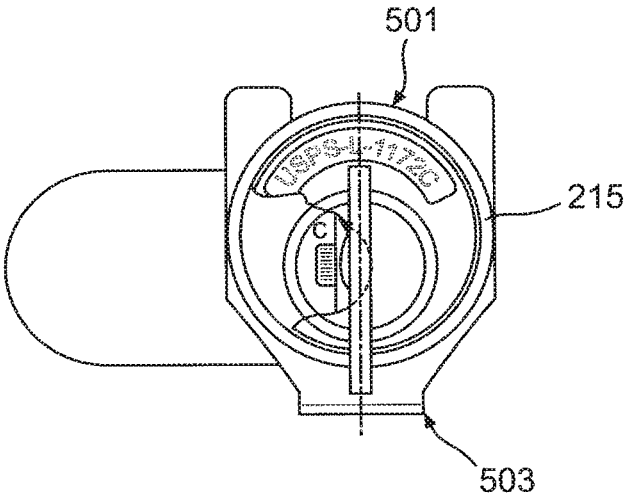
FIGS. 5(*a*)-(*b*) depict the lock of FIG. 1 mounted with an exemplary retaining clip.
Figure 5B:
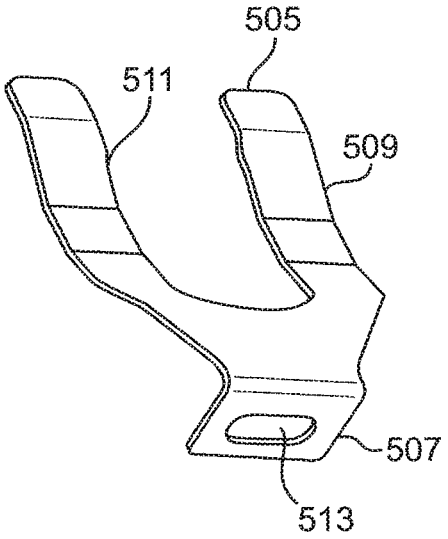

Referring now to FIG. 5(*a*)-(*b*), an exemplary locking system is shown. A lock 501 consistent with the illustrative embodiment shown in FIG. 1 and a retaining clip 503 may be mounted to storage containers, including lockers, wall-mounted lockers, wall-mounted boxes for mail, or the like. Moreover, lock 501 may be mounted to a plurality of storage containers comprising a cluster box unit. The storage container (not shown), lock 501, retaining clip 503, and restrictive mounting hole 213 consistent with the restrictive mounting hole shown in FIG. 4 (not shown in FIGS. 5(*a*)-(*b*)) may make up an exemplary system.

Consistent with the invention, retaining clip 503 comprises a substantially U-shaped bracket 505 that may be connected to a rectangular mounting piece 507 at a 90 degree angle. U-shaped bracket 505 may have an outer U-shaped edge 509 and an inner U-shaped edge 511. Rectangular mounting piece 507 may have a hole 513 cut out from the middle of the piece. Retaining clip 503 may be made out of a variety of materials. For example, steel with a zinc coating may be used.

Collar 215 may be inserted on lock 501. Lock 501 may then be inserted into restrictive mounting hole 213 (not shown in FIG. 5), which may be cut into the face of the storage container door (not shown). Retaining clip 503 may then be slid onto lock 501 such that lock 501 is positioned to sit in inner U-shaped edge 511 and retaining clip 503 is positioned between lock 501 and the back side of the storage container door. Cam 107 may then be placed in proximity to threaded portion 109 of plug 103. Mounting a threaded fastener, such as by threading nut 105 onto threaded portion 109 of plug 103, completes the mounting of lock 501. Lock 501 may not have collar 215. Mounting lock 501 without collar 215 may involve all of the steps described above except for the first step of inserting collar 215 on lock 501.

Figure 6:
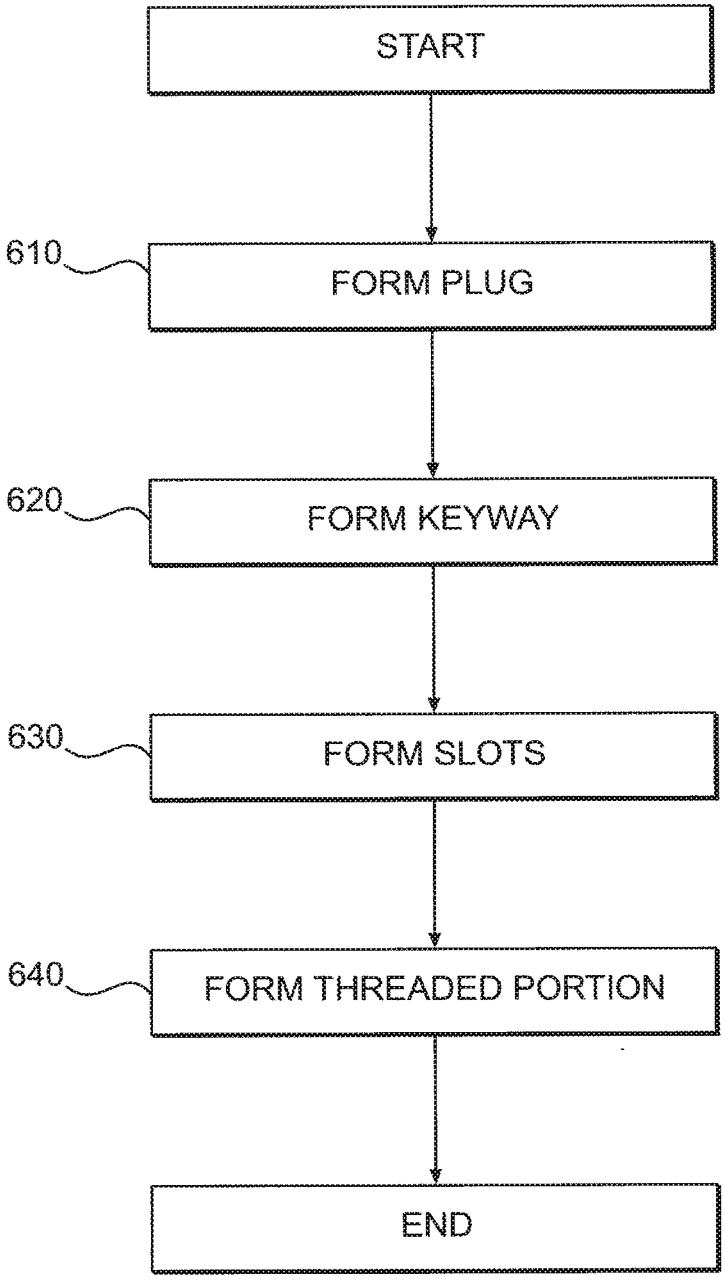
FIG. 6 is a flow chart of the operational steps of one exemplary method consistent with the present invention.

Referring now to FIG. 6, a flow chart of an exemplary method for making a plug is shown. Consistent with the illustrative embodiments, the flow chart will be described with reference to the lock shown in FIG. 1. The first step in the process 610 may involve forming plug 103. Plug 103 may be formed, for example, by the metal injection molding (MIM) method, the die cast method with secondary machining, or machining as the fabrication method. Next, in stage 620, keyway 127 may be formed. In stage 630, slots, such as holes or shafts, for receiving pin assembly 113 may be formed, by, for example, drilling a series of holes vertically into plug 103. Stage 640 may involve forming threaded portion 109 of plug 103. Threaded portion 109 may be deformed so as to provide a retention force when receiving nut 105 to resist removal of nut 105 from threaded portion 109. If plug 103 is formed using the MIM method, stages 620 through 640 may be performed at stage 610 with the precursor step of injecting mold material, such as stainless steel, into a mold of plug 103 having slots for receiving pin assembly 113 and threaded portion 109. In this embodiment, the portion of the mold of plug 103 corresponding to threaded portion 109 may have at least one deformed thread.

Figure 7:
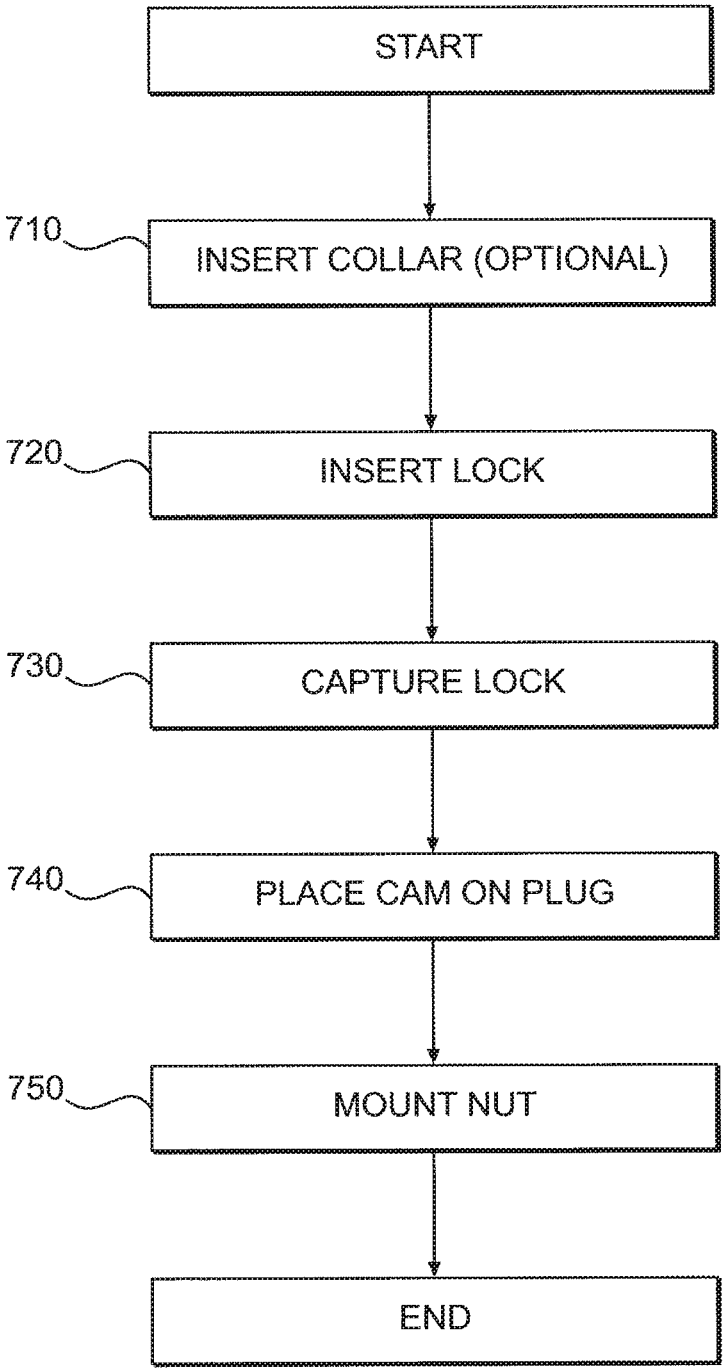
FIG. 7 is a flow chart of the operational steps of a second exemplary method consistent with the present invention.

Referring now to FIG. 7, a flow chart of an exemplary method for mounting a locking apparatus is shown. Consistent with the illustrative embodiments, the flow chart will be described with reference to the system shown in FIG. 5, the lock shown in FIG. 1, and the restrictive mounting hole shown in FIG. 4. Stage 710 may involve inserting collar 215 onto lock 501. Stage 710 may be optional, depending on whether lock 501 has collar 215. Next, in stage 720, lock 501 may be inserted through a hole in the door of a storage container. Stage 720 may be achieved by cutting restrictive mounting hole 213 and inserting lock 501 into restrictive mounting hole 213. Stage 730 may involve capturing lock 501 with a retaining clip. Stage 730 may include the step of inserting lock 501 into retaining clip 503, thereby affixing lock 501 onto the storage container door. Next, in stage 740, cam 107 may be placed on plug 103 in proximity to threaded portion 109. Stage 750 involves mounting a threaded fastener, such as by threading nut 105 onto threaded portion 109 of plug 103. Threaded portion 109 may be deformed so as to provide a retention force when nut 105 to resist removal of nut 105 from threaded portion 109.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A locking apparatus, comprising:

a cylinder having a non-cylindrical shape, the cylinder extending from a proximate end to a distal end, and including:

a top edge extending along a length of the cylinder;

a first pair of notched portions disposed on either side of the top edge and parallel to the top edge, the first pair of notched portions extending from the proximate end to a notched portion end disposed between the proximate end and the distal end; and a second pair of notched portions vertically offset from the first pair of notched portions, the second pair of notched portions extending from the notched portion end to the distal end;

a rotatable plug positioned in the cylinder and having a threaded portion;

a pin assembly configured to receive a key that selectively prevents and permits rotation of the plug; and a nut cooperating with the threaded portion of the plug.

2. The locking apparatus according to claim 1, wherein at least one of the threads of the threaded portion is deformed.

3. The locking apparatus according to claim 1, wherein the cylinder includes an arcuate bottom edge disposed opposite the top edge.

4. The locking apparatus according to claim 3, further including at least one groove extending vertically from at least one of the two notched portions to the bottom edge.

5. The locking apparatus according to claim 4, further including two substantially straight side edges extending from the arcuate bottom edge to intermediate edges disposed between the arcuate bottom and the two notched portions.

6. The locking apparatus according to claim 1, wherein the two notched portions have a first length smaller than a second length of the cylinder.

7. The locking apparatus according to claim 1, wherein the cylinder comprises a collar having a bevel.

8. The locking apparatus according to claim 1, wherein the plug further includes a keyhole disposed opposite to the threaded portion of the plug.

9. The locking apparatus according to claim 8, further including a spring-hinged dust cover resiliently movable from a first position covering the keyhole to a second position exposing the keyhole.

10. The locking apparatus according to claim 1, wherein the plug is made of stainless steel material.

11. The locking apparatus according to claim 10, wherein the stainless steel material includes one of metal-injection-molded stainless steel, precipitation-hardened stainless steel, precipitation-hardened stainless steel casting, or age-hardened stainless steel.

12. A box, including:

a door having a non-cylindrical mounting hole;

a lock including:

a cylinder, having:

a top edge extending along a length of a cylinder body extending from a proximate end to a distal end;

a first pair of notched portions disposed parallel to the top edge and vertically offset from the top edge, the pair of notched portions extending from the proximate end to a notched portion end disposed between the proximate end and the distal end; and a second pair of notched portions vertically offset from the first pair of notched portions, the second pair of notched portions extending from notched portion end to the distal end;

a rotatable plug positioned in the cylinder and having a threaded portion;

a pin assembly configured to receive a key that selectively prevents and permits rotation of the plug;

a nut cooperating with the threaded portion of the plug; and a cam disposed between the nut and the plug; and a retaining clip positioned between the non-cylindrical mounting hole and the lock.

13. The box according to claim 12, wherein the non-cylindrical mounting hole includes:

a top edge;

an arced bottom edge disposed opposite the top edge; and two notched portions disposed on either side of the top edge between the top edge and the bottom edge.

14. The box according to claim 13, wherein the mounting hole further includes two side edges extending between the arced bottom edge and a respective one of the two notched portions.

15. The box according to claim 12, wherein the cam includes a hole configured to receive the threaded portion of the plug.

16. The box according to claim 12, wherein the retaining clip further includes:

a pair of legs forming a substantially U-shaped bracket configured to receive the lock between the pair of legs; and a mounting piece disposed perpendicular to the bracket.

* * * * *